US007146784B1

(12) United States Patent
Portrait

(10) Patent No.: US 7,146,784 B1
(45) Date of Patent: Dec. 12, 2006

(54) MACHINE FOR PACKAGING A PLURALITY OF ARTICLES IN A CARTON, AND METHOD OF FORMING A CARTON

(75) Inventor: Pascal Portrait, Saint-Gaultier (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 09/600,434

(22) PCT Filed: Jan. 15, 1999

(86) PCT No.: PCT/US99/00853

§ 371 (c)(1),
(2), (4) Date: Oct. 2, 2000

(87) PCT Pub. No.: WO99/36317

PCT Pub. Date: Jul. 22, 1999

(30) Foreign Application Priority Data

Jan. 16, 1998 (GB) ..... 9800884.0

(51) Int. Cl.
*B65B 35/30* (2006.01)
*B31B 1/88* (2006.01)

(52) U.S. Cl. ..... 53/544; 53/367; 53/446; 53/458; 493/55

(58) Field of Classification Search ..... 53/444, 53/446, 458, 55, 67, 153, 167, 564, 256, 53/258, 578, 574, 559, 148, 534, 539, 531, 53/58, 252, 416; 493/10, 15, 30, 55, 104, 493/119, 318; 198/397.06, 419.3, 594, 416
See application file for complete search history.

(56) References Cited

U.S. PATENT DOCUMENTS 3,941,037 A 3/1976 Reichert ..... 493/167
3,958,688 A * 5/1976 Sterling ..... 198/416
4,106,262 A * 8/1978 Aterianus ..... 53/450
4,250,693 A 2/1981 Andersson ..... 53/543
4,308,943 A * 1/1982 Gierhart ..... 198/399
4,472,217 A * 9/1984 Kontz ..... 156/350
4,807,428 A 2/1989 Boisseau ..... 53/563
4,982,551 A 1/1991 Nigrelli, Sr. ..... 53/55
5,175,976 A * 1/1993 Petry et al. ..... 53/252

(Continued)

FOREIGN PATENT DOCUMENTS

EP 0 734 948 A1 10/1996

(Continued)

*Primary Examiner*—Rinaldi I. Rada
*Assistant Examiner*—John Paradiso
(74) *Attorney, Agent, or Firm*—Michael V. Drew; Tsugihiko Suzuki; Thomas A. Boshinski

(57) ABSTRACT

A packaging machine for loading a plurality of articles into a carton which mechanism comprises carton erecting means for part erecting said carton to define a first article receiving cell, means for selecting a group of articles comprising at least two articles, means for separating said grouped articles from an adjacent like group of articles, means for loading said grouped articles into said first article receiving cell through an open end thereof in the packaging carton and a means for completing the construction of the carton. There also comprises a mechanism for forming a carton including a pair of article receiving cells comprising complementary die members, each said die member being mounted to a rotating wheel wherein each said complementing die member is adapted to interengage when a blank is positioned between the two members, such that said die members cause the blank to be folded to define said article receiving cells.

9 Claims, 7 Drawing Sheets

U.S. PATENT DOCUMENTS

| | | | | | |
|---|---|---|---|---|---|
| 5,454,211 | A | * | 10/1995 | Ziegler et al. | 53/252 |
| 5,481,848 | A | * | 1/1996 | Tagliaferri et al. | 53/157 |
| 5,531,661 | A | * | 7/1996 | Moncrief | 493/313 |
| 5,657,610 | A | * | 8/1997 | Dietrich et al. | 53/139.5 |
| 6,370,844 | B1 | * | 4/2002 | Stricker | 53/446 |

FOREIGN PATENT DOCUMENTS

| | | | |
|---|---|---|---|
| FR | 2 286 708 | | 4/1976 |
| JP | 5-42904 | * | 2/1993 |
| WO | WO 97/26188 | | 7/1997 |

* cited by examiner

MACHINE FOR PACKAGING A PLURALITY OF ARTICLES IN A CARTON, AND METHOD OF FORMING A CARTON

BACKGROUND OF THE INVENTION

This invention relates to a packaging machine which is especially suitable for processing multiple package cartons from blank form to completed filled multiple unit cartons and to a method of forming such cartons. The machine can be readily adjusted to accommodate a wide range of carton sizes without undue time being taken to adapt the machine for running one size of carton to running a different size of carton.

The majority of known packaging machines are dedicated machines which construct only size of one type of carton. Therefore, it is necessary to use a plurality of packaging machines to package different carton types, each machine taking up considerable floor space and being expensive to both purchase and operate.

In packaging machines which are required to construct cartons comprising internal compartments for holding a given number of articles, the construction of these cartons is often complex and often dictates the speed of the machine. What is required is a packaging machine which can construct compartments within a carton with a minimum number of folding operations.

A further problem arises when loading the articles into the compartments and in particular where those compartments are in a spaced arrangement. It is known to provide article metering mechanisms which continuously load a group of articles into cartons, for example, wrap-around cartons used in beverage multiple packs. However, where carton compartments are in a spaced relationship, it is necessary for some form of article grouping to be adapted.

SUMMARY OF THE INVENTION

It is an object of the present invention to provide a packaging machine which overcomes the technical and commercial disadvantages of known packaging machines.

In cartons where a display portion is provided, it is often desirable for display indicia to be shown through the display portion. The majority of known packaging machines are not able to orientate the display indicia on an article, for example, a label, so that it can be displayed. A limited number of packaging machines incorporate equipment to orientate the containers. However, this equipment is usually complex or extremely costly for example, use of survey motors or optic fibre and a printed colour spot on the label to identify (i) a suitable reference point and (ii) to align the reference point at the correct position.

Thus it is a further object of the present invention to provide a mechanism for incorporation into a packaging machine which is capable of orienting containers for example, batteries, using equipment which is relatively inexpensive and simple.

According to a first aspect of the invention there comprises a packaging machine for loading a plurality of articles into a carton which mechanism comprises carton erecting means for part erecting said carton to define a first article receiving cell, means for selecting a group of articles comprising at least two articles, means for separating said grouped articles from an adjacent like group of articles, means for loading said grouped articles into said first article receiving cell through an open end thereof in the packaged carton and a means for completing the construction of the carton characterised in that said carton erecting means comprises complementary die members, each said die member being mounted to a rotating wheel wherein each said complementary die member is adapted to inter engage when a carton blank is positioned between the two members, such that said die members cause the blank to be folded to define said receiving cells. Preferably, the carton erecting means may comprise a device which effects a change in configuration of the carton from an inoperative configuration in which said first article receiving cell is formed to receive said grouped articles.

According to an optional feature of this aspect of the invention one of the complementary members may comprise a protruding portion extending from a working face of the complementing member and wherein the other said complementing member comprises a recessed portion adapted to receive said protruding portion and wherein the blank is placed on said receiving member and wherein the protruding portion forces part of the blank into said receiving portion.

According to another optional feature of this aspect of the invention one of the complementary members may comprise a protruding portion extending from a working face of the complementing member and wherein the other said complementing member comprises a recessed portion adapted to receive said protruding portion and wherein the blank is placed on said receiving member and wherein the protruding portion forces part of the blank into said receiving portion.

According to another feature of this aspect of the invention the selecting means may comprise a plurality of channels mounted on an endless chain which channels are grouped to correspond to the number of articles to be placed into the first article receiving cell and wherein the channels are adapted to substantially align each article with the first article receiving cell.

According to another feature of this aspect of the invention, the carton may comprise a second article receiving cell formed by the carton erecting means in a spaced relationship to the first article receiving cell wherein the grouped channels comprise at least two channels in substantially parallel relationship to one another wherein said at least two channels are adapted to diverge into a plurality of sub-groups wherein each sub-group is spaced to align an article held in each sub-group with one of the article receiving cells.

optionally, the packaging machine of this aspect of the invention may further comprise a conveyor including means to convey the articles and means to regulate the flow of articles to enable the articles to be aligned with each carton.

A second aspect of the invention provides a method of loading a plurality of articles into a carton whilst the articles and carton are moved in a synchronised manner and in a continuous forward direction comprising the following steps:

transferring carton blank from a stowed position and erecting the blank to form the carton;

selecting a group of articles to be loaded into the carton;

synchronously associating an article receiving cell formed from the blank with a given number of said grouped articles by sideways movement of the articles; and transferring the carton and loading said grouped articles into a carton through an open end thereof. The blank is erected by erecting means comprising complementary die members, each die member being mounted to a rotating wheel wherein each complementary die member is adapted to inter engage when a blank is positioned between the two members, such that the die members cause the blank to be folded to define the article receiving cells.

A third aspect of the invention provides a mechanism for forming a carton including a pair of article receiving cells comprising complementary die members, each die member being mounted to a rotating wheel wherein each complementary die member is adapted to inter engage when a blank is positioned between the two members, such that the die members cause the blank to be folded to define the article receiving cells.

According to an optional feature of the third aspect of the invention, one of the complementary members may comprise a protruding portion extending from a working face of the complementary member and wherein the other complementary member comprises a recessed portion adapted to receive the protruding portion and wherein the blank is placed on the receiving member and wherein the protruding portion forces part of the blank into the receiving portion.

A fourth aspect of the invention provides a mechanism for grouping a plurality of articles which mechanism comprising an endless series of channels along which articles may be transferred into a plurality of article receiving cells of a carton wherein the channels are organised into groupings whereby each grouping corresponds to a given number of articles to be loaded in the carton.

According to an optional feature of the fourth aspect of the invention the channels are adapted to be substantially parallel to one another and then diverge into sub-groupings wherein each sub-group is spaced to align an article held in each sub-group with one of the article receiving cells corresponding to each one of the cells of each carton and wherein the sub-groupings are each substantially parallel to one to provide in line parallel access to the cells.

A fifth aspect of the invention provides a mechanism for causing a label affixed to an article to be oriented to a predetermined display position wherein the article includes a portion protruding outwardly of the article in a fixed position relative the label, wherein the mechanism comprises support means adapted to support an article, orientation means adapted to cause the article to rotate in the support means until the protruding position is restrained by abutment means formed in the support means. Preferably, one edge of the label affixed to the article overlays an opposed edge of the label to define the protruding portion.

According to an optional feature of this aspect of the invention, the support means may comprise a channel including a support surface to retain part of the article within the channel. Preferably, the support surface may substantially correspond to the exterior surface of the retained part of the article.

According to another optional feature of the fifth aspect of the invention the orientation means may comprise an elongate member connected to resilient means, wherein the elongate member is adapted to abut a portion of the article as the support means is moved in a substantially parallel plane to the elongate member such that a tangential force is applied to the abutting portion of the article to cause the article to rotate. Optionally, the resilient means may be adapted to reduce the tangential force when the protruding portion is restrained by the abutment means.

According to a further optional feature of the fifth aspect of this invention, the abutment means may be formed from an upper edge of the channel.

A sixth aspect of this invention provides a method of orienting to a predetermined display position wherein the article includes an outwardly protruding portion in a fixed position relative the label a label affixed to an article which method comprising the steps of supporting the article in support means during forward movement, rotating the article within the support means until the protruding portion abuts a portion of the support means and retaining the article in its desired orientation for loading into a carton.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
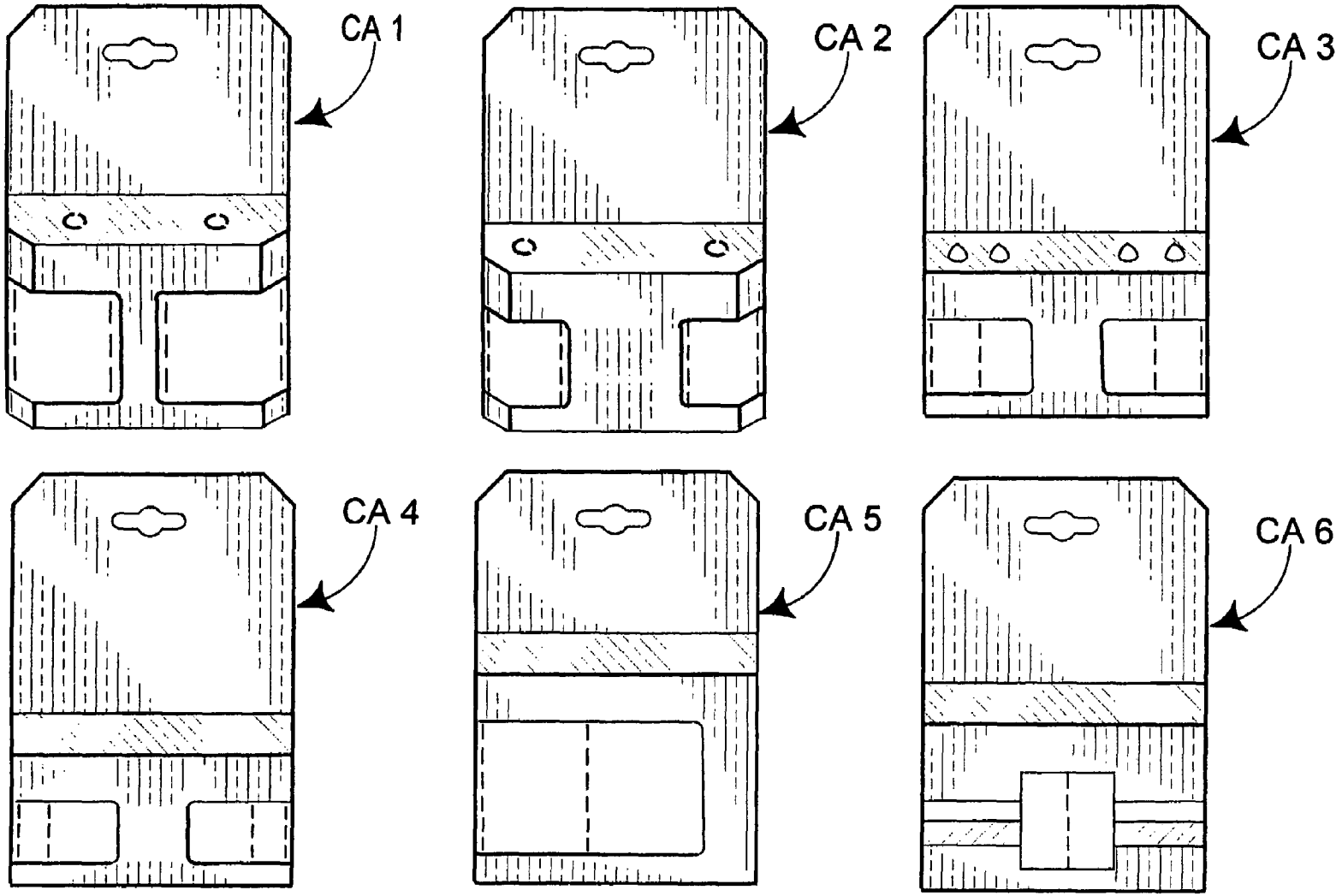
FIG. 1 is a perspective view of a selection of "blister pack" type cartons packaged by a machine according to one or more aspects of the invention.

The machine according to the present invention is capable of loading cartons comprising compartments for retaining a given number of articles within each compartment. A selection of cartons(CA1 to CA6) suitable for being packaged by such a machine is illustrated in FIG. 1.

Figure 2:
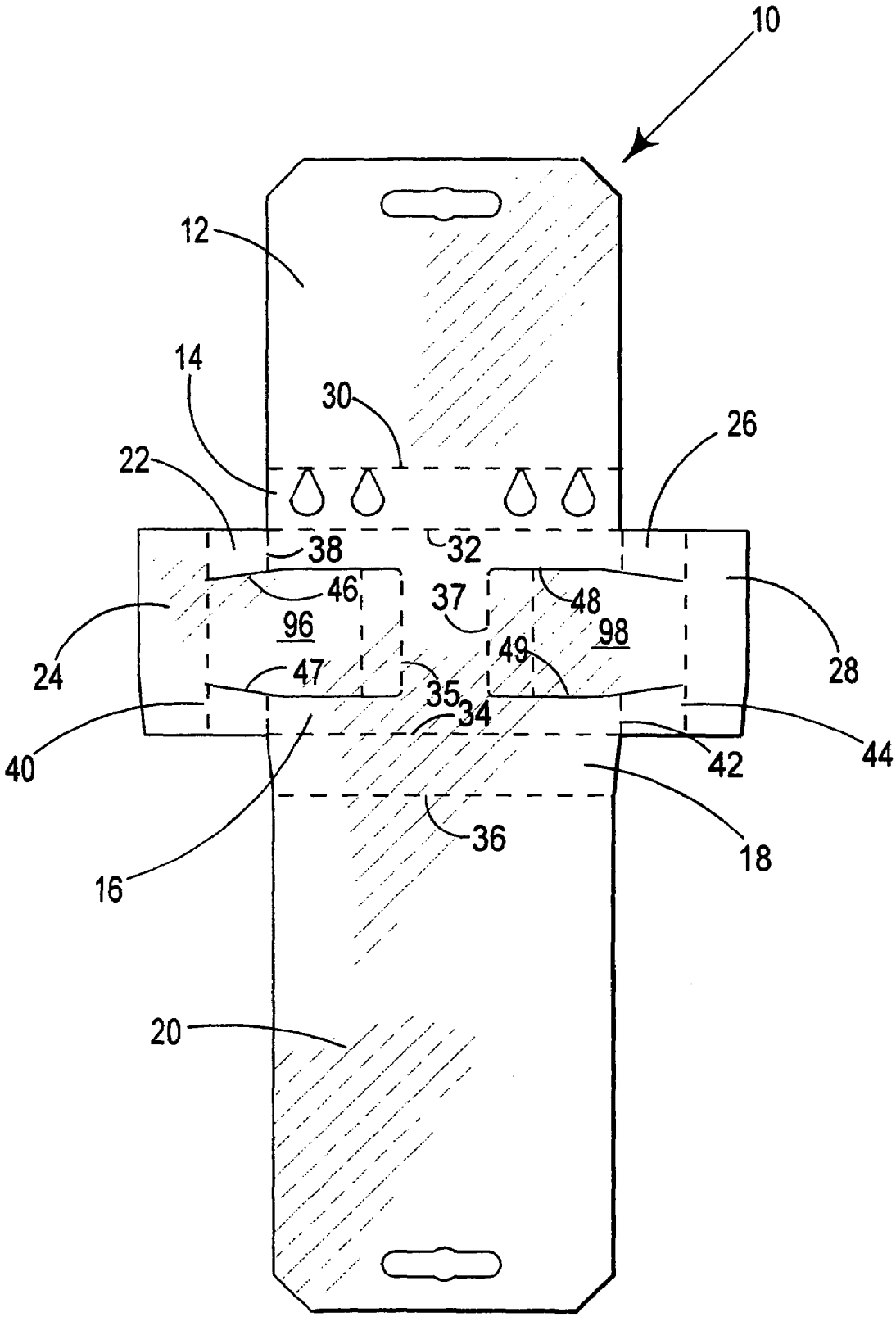
FIG. 2 is a plan view of a unitary blank used to construct one type of carton capable of being used with a machine according to the invention.

FIG. 2 shows an example of a carton which can be constructed and loaded by a packaging machine of the present invention. Thus, there comprises a unitary blank 10 formed from paperboard or other suitable material, which blank 10 comprises a series of panels hinged one to the next. Thus support panel 12 in hingably connected to top panel 14 along fold line 30. Top panel 14 is connected by way of fold line 32 to side panel 16. Side panel 16 is hingably connected along fold line 34 to bottom panel 18. Base panel 18 is hingably connected to second support panel 20 by means of fold line 36. In a set up condition, support panels 12, 20 are connected together in a face to face relationship by glue or other suitable means.

End panel 22 is hingably connected to side panel 16 along fold line 38 and strengthening panel 24 is hingably connected by means of fold line 40 to the opposing side of end panel 22. Likewise, end panel 26 is hingably connected to side panel 16 along fold line 42 and strengthening panel 28 is hingably connected to the opposing side of end panel 26 along fold line 44.

In a set up condition, top panel 14, side panel 16, bottom panel 18 and a portion of support panel 20 co-operate to form a hollow display box. End panels 22, 26 provide closures for the box, with strengthening panels 24, 28 being secured, such as by gluing, to support panel 20 to maintain the box in set up condition. Side panel 16 provides a display face for the package, while support panel 20 provides a back panel.

Figure 3:
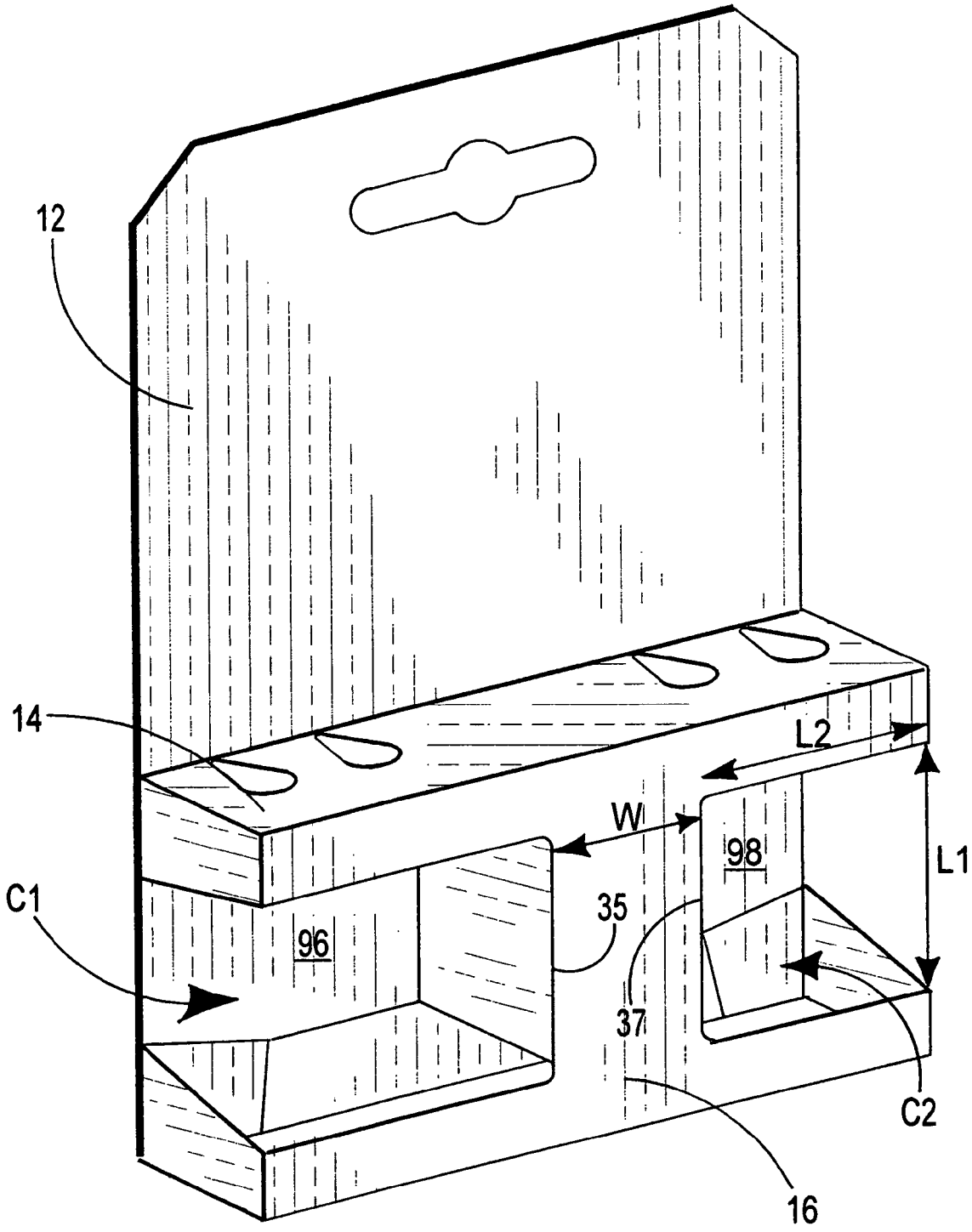
FIG. 3 is a perspective view of one type of carton formed from the blank shown in FIG. 2.

The carton incorporates two securing cells or display windows C1, C2 constructed from partition sections 96, 98 as illustrated in FIG. 3. Turning again to FIG. 2, partition section 96 is struck from side panel 16 and end panel 22 along opposing cut lines 50, 52. Partition section 96 is hinged to side strengthening panel 24 along fold line 40. When the carton is in a set up condition, this partition section will define an individual cell. Likewise partition section 98 is struck from side panel 16 and end panel 22 along opposing cut lines 50, 52. Partition section 96 is hinged to side strengthening panel 24 along fold line 40. When the carton is in a set up condition, this partition section will define an individual cell.

It is envisaged that the carton can vary depending upon the shape and/or quantity of articles to be packaged and accordingly, a machine in accordance with the present invention is adjustable in numerous respects so that it can process a wide variety of such cartons and is not limited to the specific example outlined above.

Figure 4:
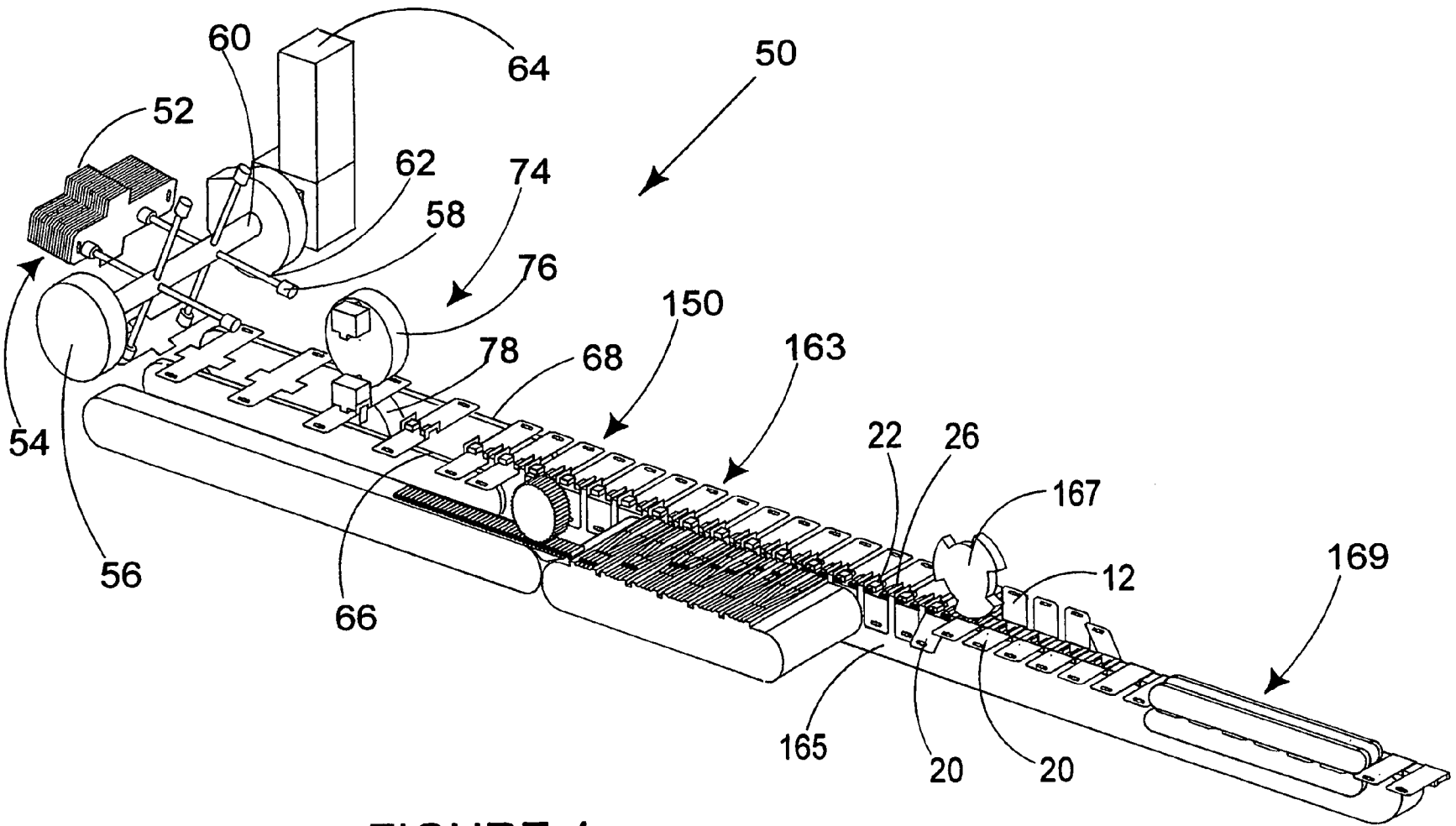
FIG. 4 is a perspective view of a machine according to one or more aspects of the invention.

Referring now to FIG. 4 of the drawings, there is shown a machine for processing cartons 52 of the type outlined above. The upstream end of the machine includes a hopper 54 in which a multiplicity of cartons 52 in flat collapsed condition are held ready for processing. As shown in FIGS. 4 and 5, the cartons are removed from the hopper 54 sequentially by a rotary vacuum feeder 56. The vacuum feeder 56 comprises four pairs of suction cups 58 each being connected to a drive shaft 60 by a drive rod 62. Driving means 64 for example a servo motor, is used to rotate the drive shaft 60. The drive shaft 60 can be connected to a cam track by a cam rod not shown to provide a uniform path with suction cups when the drive shaft 60 is rotated.

The hopper 54 is, in this embodiment, a 'gravity feed' type whereby the carton blanks 52 are held on the hopper at an incline to provide a positive feed. Thus as shown in FIG. 5, a carton in flat collapsed condition is removed from the hopper 54 and is rotated by the vacuum feeder 56 to the in-feed end of the machine 54. The blank is placed onto a pair of endless chains 66, 68, for example, side lug chains, and is held in position by suitable support means, for example leading and trailing lugs 70, 72 mounted upon the endless chains 66, 68 respectively. The lug sets 70, 72 maintain the position of the carton and move the carton downstream to the set-up station shown generally at 74.

Figure 5B:
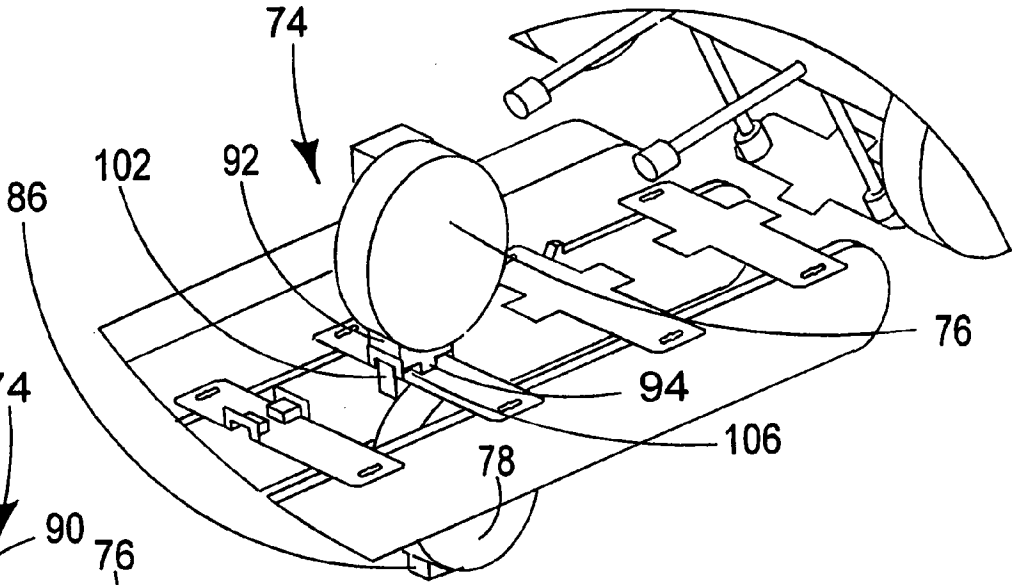
FIGS. 5*a* and 5*b* are perspective views of the carton supply in-feed and set-up stations of the machine shown in FIG. 4.
Figure 5A:
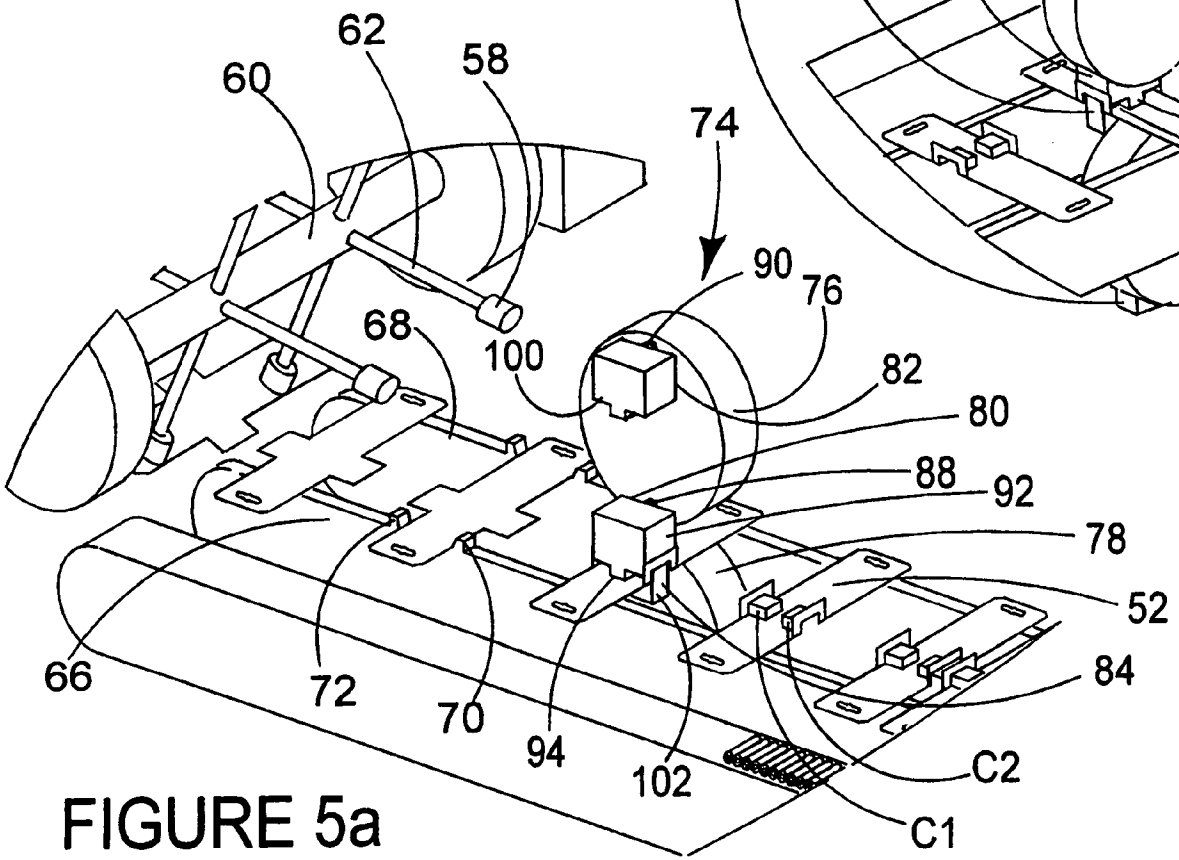

The set-up station 74 is shown in FIG. 5, and it includes a pair of rotating wheel units 76, 78 which, in this embodiment, are positioned above and below the carton. Of course, the position of the units is not limited to their position shown in the drawings. The rotating wheels 76, 78 can be powered by known driving means for example servo motors. In this embodiment, each rotating wheel unit 76, 78 comprises a pair of die members 80, 82, 84, 86 mounted to each rotating wheel by a shaft 88, 90. Each wheel unit 76, 78 in opposed positions includes cam track and cam as described below. In other embodiments, the rotating wheels 76, 78 can comprise more than two die members, if manufacturing requirements or the packaging speed dictate that such a modification be preferable. Turning to the construction of the die members 80, 82 of the upper wheel 76, it is envisaged in this embodiment that both die members 80, 82 are identical in construction, so only one of the members 80 is described in any greater detail. As illustrated in FIGS. 5*a* and 5*b*, the upper rotating wheel 76 comprises a (male) die member formed from a substantially rectangular block 92 mounted to the rotating wheel 76 by a shaft 88. In use, the wheel rotates in direction "B" A protruding portion extends from the lower surface 100 of the block. In this embodiment, the protruding portion is shaped to correspond to the width "W" between adjacent fold lines 35, 37, shown in FIG. 3, and the remaining portion of the lower surface 100 is shaped to correspond to partition sections 96, 98 defining the article receiving cells C1, C2.

Likewise, the lower rotating wheel 78 comprises the corresponding (female) die member 84, 86 formed from a substantially rectangular block 102 mounted to the rotating wheel 78 by a shaft 90. In use, the wheel rotates in direction "C". The upper surface 104 of the block comprises a recessed portion 106 which is shaped to receive the corresponding protruding portion 94 from the lower surface 100 of block 92. As the carton blank 52 is moved forward by the endless chains 60, 68, the lower surface of the carton blank 52 comes into contact with the (female) die member 84 or 86.

Preferably, the block 92 mounted to the upper rotating wheel 76 is rotated in unison with the lower block 102. Thus, the upper block 92 can come into contact with the upper surface of the carton blank 52. As the upper and lower blocks 92, 102 continue to move in directions B and C respectively, the cam track and cam arrangement within the rotating wheels 76, 72 cause the blocks to interengage whereby the protruding portion 94 is received by the corresponding recessed portion 106. In this embodiment, the side panel 16 is thereby pushed in a downward direction and folded about fold lines 35, 37 to erect a pair of display windows or cells C1, C2, as shown in FIGS. 5*a* and 5*b*. The upper and lower blocks 92, 102 are then separated to release the carton 52 as it moves forward to the loading station 150 by the leading and trailing lugs 70, 72 on the endless chains 66, 68. It is envisaged that the setting up station 74 and the process of "punching" the carton into a part erected form is a continuous process so that the carton is moved in a continuous forward direction as the carton erecting operation is performed.

If an alternative type of blister pack is required to be packaged, then the blocks 92, 102 can be connected to the rotating wheel units by suitable securing means (not shown), for example quick release mechanism, so that the blocks can be interchanged with a second pair of differently configured blocks which can be used to part erect a second carton type.

After the cartons have been part erected to define article receiving cells, they are successively transferred to the loading station 150 shown in FIG. 4 by which the cartons move downstream by the pair of side lug chain sets 66, 68.

At the loading station 150, articles (A), for example batteries, are fed into the machine 50 by an end feed conveyor 152 and the line pressure of the batteries is controlled by an in feed star wheel 154, as is well known. Thereafter, the articles may be transferred from the end feed conveyor 152 to an article grouping conveyor 156 shown in FIG. 6. The article grouping conveyor 156 separates the articles into groups of the correct number per blank by means of a series of channels 158 mounted to an endless chain 160, which articles (A) can be transferred into a plurality of articles receiving cells, C1, C2 (for example, two) of the carton.

Figure 6:
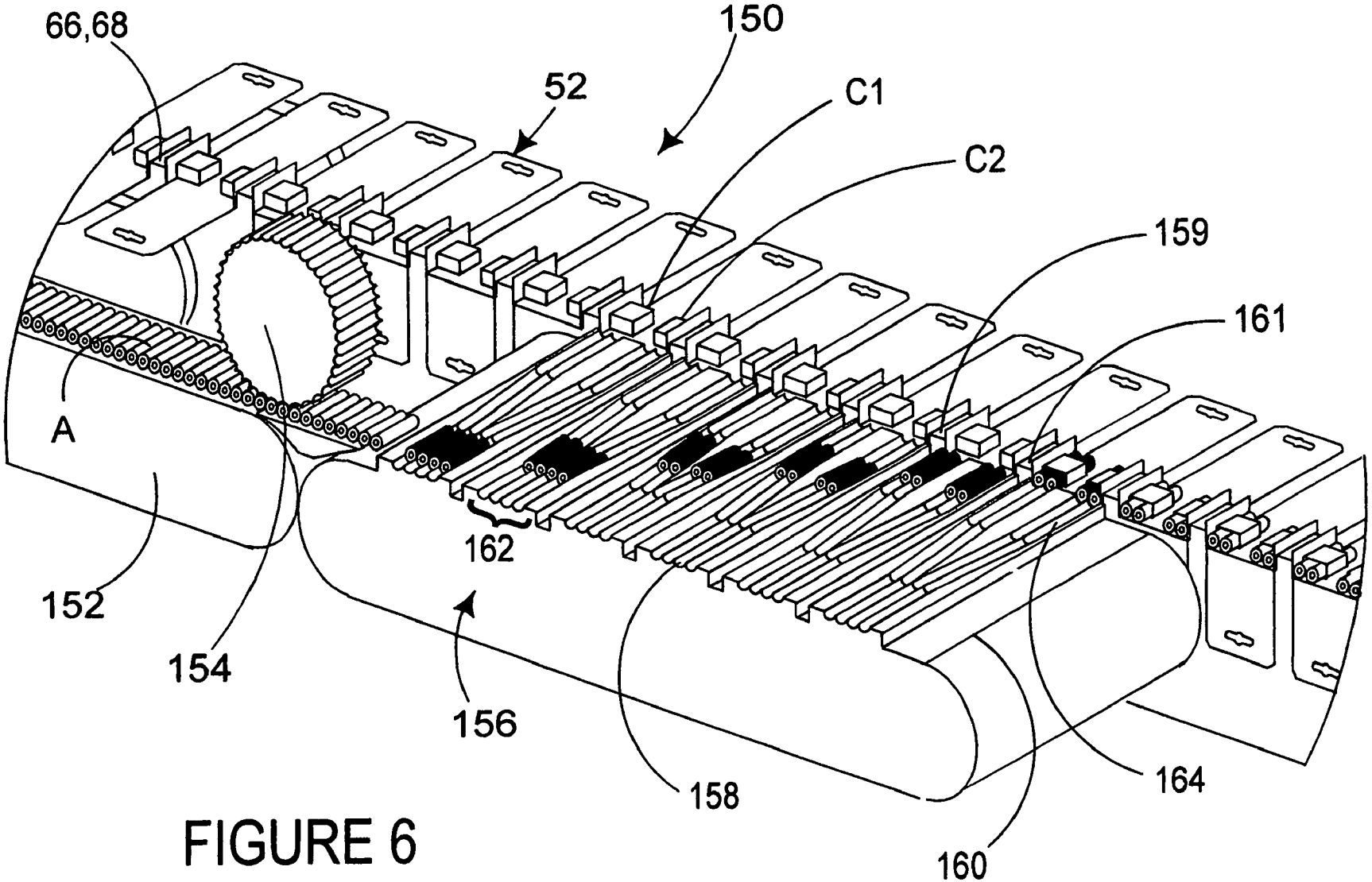
FIG. 6 is a perspective view of the carton conveyor and loading station of the machine-shown in FIG. 4.

As shown in FIG. 6, the channels 158 are organised into groupings, for example, four, whereby each grouping 162 corresponds to a given number of articles to be loaded in the carton. Suitable guide means (not shown), for example, guide rail and static guide, are used to push the articles in to the respective cells, and the grouping conveyor 156 is used to control the flow of articles (A) so that they can be introduced to the carton 52 at the same rate as the carton blank flow.

In the class of embodiments which include cartons with more than one article receiving cell, then the channels 158 are adapted to diverge into sub-groupings 164 whereby each sub-group 164 is spaced to align an article or articles (A) held in each sub-group 164 with one of the article receiving cells C1, C2. As shown in FIG. 6, each sub-grouping is shaped to provide channels 158 which are substantially parallel to corresponding article receiving cells C1, C2 in order to provide in-line parallel access to the aforesaid cells.

Figure 8B:
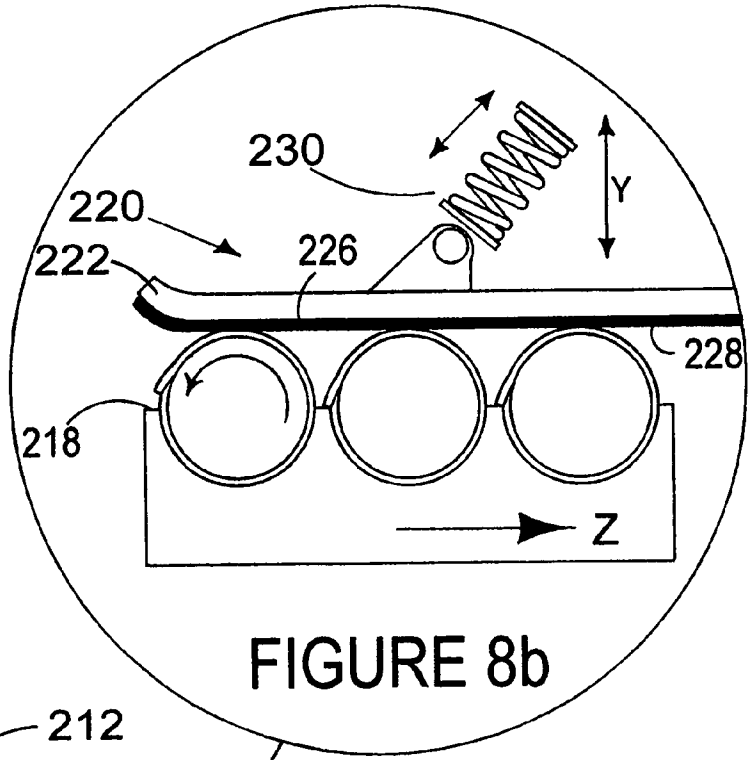
FIGS. 8*a*, and 8*b* illustrate a mechanism for orientating the labels affixed to an article according to another aspect of the invention.
Figure 8A:
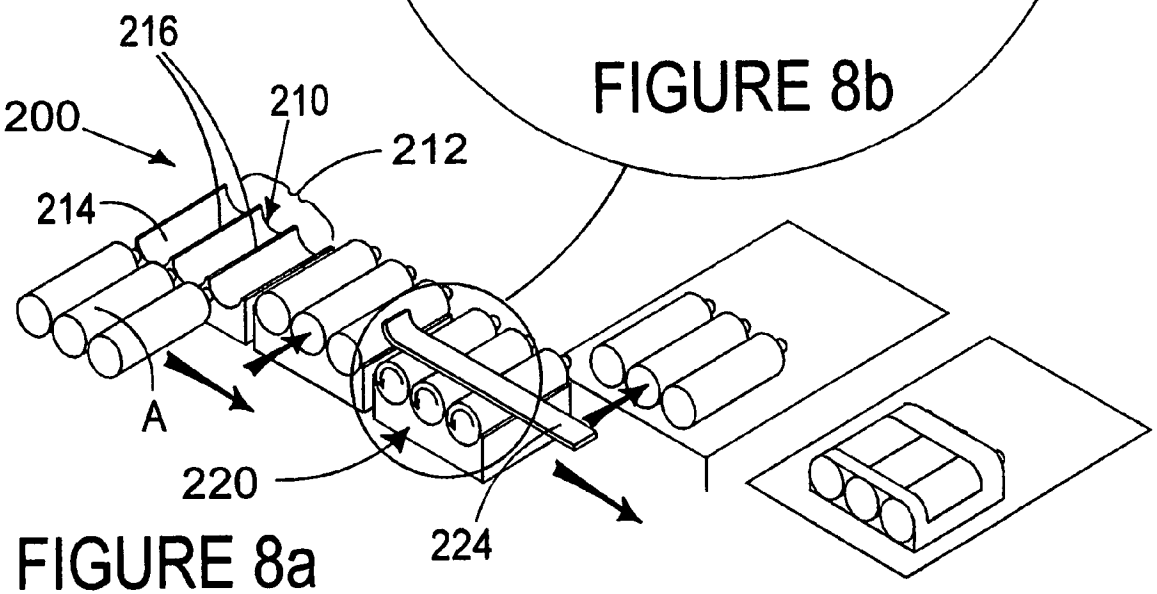
Figure 7:
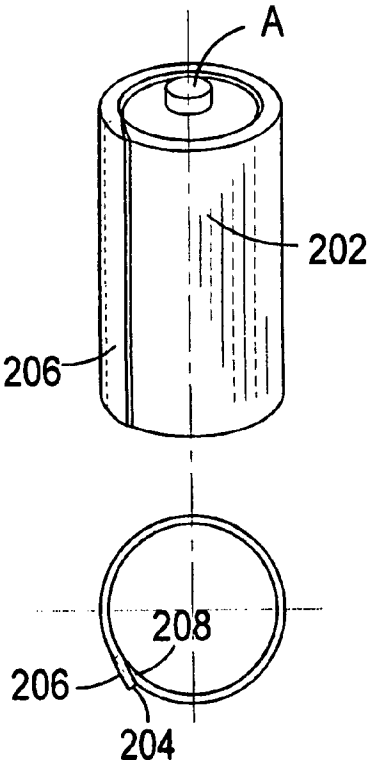
FIG. 7 illustrates one type of article to be packaged by the machine according to the invention.

Optionally, the machine may include a mechanism 200 shown in FIG. 8 for causing a label 202 affixed to an article (A) to be oriented to a pre-determined display position. Preferably, the articles to be packaged include a portion protruding 203 outwardly of the article in a fixed position relative said label. As shown in FIG. 7, the protruding portion 204 is formed by the side edges 206, 208 of the label 202 being placed in an overlapping relationship. As the articles are moved forward, they are inserted in to support means 210 adapted to support the articles (A). As shown in FIG. 8*a*, the support means 210 comprises a group of channels (or holding combs) 212 adapted to receive part of an article. In this embodiment, each channel comprises a support surface 214 which substantially corresponds to the shape and configuration of the outer surface of the article (A). Of course, the different profiles of channel can be used, for example, a square d section, without departing from beyond the scope of the invention. Adjacent each channel 212 there comprises abutment means 216 adapted to restrain the protruding portion 204 of the article. In this embodiment, a surface 218 connecting adjacent channels 212 is used as the abutment (or pre-set stop) means 216.

Referring again to FIG. 8*a*, each channel 204 is loaded with an article and the articles are successively moved forward to the orientation means 220 which is adapted to cause the articles to rotate in the support means 210. The orientation means 220, illustrated in greater detail in FIG. 8*b*, comprises an elongate member 222 held in a fixed position relative to the channels 212. The elongate member 222 (or static member) can comprise a strip 224 including a working surface 226. Alternatively, the elongate member 222 can comprise a flexible belt (not shown) held in a fixed position, or driven in a direction substantially opposed to direction "Z" shown in FIG. 8*b*. The working surface 226 preferably includes a layer of friction inducing material 228, for example, rubber or other suitable plastic materials. The strip is connected to a support frame (not shown) by resilient means 230, for example, a spring mechanism. Preferably, the length of the strip 224 should be equal to or greater than the circumference of the article (A) being rotated to ensure that each article can be rotated by up to 360 degrees.

As shown in FIG. 8*b*, the articles and channels 204 are moved in direction "Z" and are brought into contact with the orientation means 220. Therefore, the strip 224 comes into contact with the upper portion of the article and as it is fixed relative the articles and channels 204 a tangential force is applied by the orientation means 220 to the articles which causes them to rotate. The channels 204 continue to move forward and the articles (A) continue to rotate until the protruding portion 203 comes into abutment with the abutment means 216. Thus, the article is orientated to the correct position and can then be loaded into the cartons.

Once the article (A) has been oriented to its correct position, the increased resistance of the article when it ceases to rotate applies an upward force to the strip 224. The resilient means 230 is used to reduce the tangential forces applied to the article (A) by the orientation means 220, whereby the strip 224 is capable of being moved by small amounts in a vertical plane "Y" in order to prevent or at least minimise the prospect of a carton label 202 being torn or damaged.

It is envisaged that the article orienting mechanism can be incorporated into a machine described above, for example, at the upstream end of the grouping conveyor. It is further envisaged that this mechanism can be used in various types of packaging machines. Alternatively, the article orienting mechanism of the present invention can be sold as an individual module to be fitted to new equipment or to existing equipment on a retro fit basis.

At the loading station 150 shown in FIG. 6, the groups of articles or sub-groupings are introduced to the carton from one side as the carton and article group are moved forward in unison. The lateral movement of the carton in the loading station is controlled by a pair of guides 159, 161 positioned adjacent the end panels 22, 26 of each carton. It is envisaged that in other embodiments a pressure belt could replace fixed guides or, where appropriate, those particularly mounted endless chain and lug sets could be used.

Once the cartons have been loaded with articles, they are transferred by means of a conveyor 163 and/or a pressure belt to a further set of endless chains 165 with side lugs which are used to transfer the carton to the outfeed end of the machine shown, in FIG. 4. During this stage, the second support panel 20 is folded upwardly, and around the articles, by means of a fixed guide (not shown). Further, the end panels 22, 26 are folded about fold lines 38, 42 to enclose the article receiving cells C1, C2 by a folding wheel 167 and glue flaps 24, 28 are connected to the cells C1, C2 by glue or other means known in the art. Support panel 12 is then folded and secured to panel 20 by suitable securing means, for example glue or other means known in the art. Thereafter, pressure belts 169 can be applied to the carton to secure the panels in place and to complete the forming process.

Further modifications may be made without departing from the scope of the present invention. In particular, alternate sensors and alternate means of positioning each of the moveable articles may be utilised without departing from the scope of the invention as claimed in the accompanying claim. In addition, while the preferred embodiment described herein is for loading batteries into cartons, it will be recognised that the invention is not limited to cartons for batteries. The invention may be used with the machines for packaging cans, paperboard bricks, bottles and other containers into cartons. Further, the present invention is able to process cartons comprising numerous configurations of groups of articles covering a range of carton sizes and shapes, for example two, four, six or eight articles, without undue time being spent in adjusting the mechanism.

The invention claimed is:

1. A packaging machine, for loading a plurality of articles into a carton which mechanism comprises carton erecting means for part erecting said carton to define a first article receiving cell, means for selecting a group of articles comprising at least two articles, means for separating said grouped articles from an adjacent like group of articles, means for loading said grouped articles into said first article receiving cell through an open end thereof in the packaged carton and a means for completing the construction of the carton characterised in that said carton erecting means comprises complementary die members, each said die member being mounted to a rotating wheel wherein each said complementary die member is adapted to inter engage when a carton blank is positioned between the two members, such that said die members cause the blank to be folded to define said article receiving cells, one of said complementary die members having a protruding portion extending from a working face thereof and the other of said complementary die members having a recessed portion adapted to receive said protruding portion, when said blank is placed on said receiving member the protruding portion forces part of the blank into said receiving portion.

2. The packaging machine as claimed in claim 1 wherein said carton erecting means comprises a device which effects a chance in configuration of the carton from an inoperative configuration in which said first article receiving cell is formed to receive said grouped articles.

3. The packaging machine as claimed in claim 1, wherein said selecting means comprises a plurality of channels mounted on an endless chain which said channels are grouped to correspond to the number of articles to be placed into said first article receiving cell and wherein the channels are adapted to substantially align each said article with said first article receiving cell.

4. The packaging machine as claimed in claim 3 wherein the carton comprises a second article receiving cell formed by said carton erecting means in a spaced relationship to said first article receiving cell wherein said grouped channels comprise at least two channels in substantially parallel relationship to one another wherein said at least two channels are adapted to diverge into a plurality of sub-groups wherein each said sub-group is spaced to align an article held in each said sub-group with one of said articles receiving cells.

5. The packaging machine as claimed in claim 1 further comprising a conveyor including means to convey the articles and means to regulate the flow of articles to enable the articles to be aligned with each said carton.

6. A packaging machine for loading a plurality of articles into a carton which mechanism comprises carton erecting means for part erecting said carton to define a first article receiving cell, means for selecting a group of articles comprising at least two articles, means for separating said grouped articles from an adjacent like group of articles, means for loading said grouped articles into said first article receiving cell through an open end thereof in the packaged carton and a means for completing the construction of the carton characterised in that said carton erecting means comprises complementary die members, each said die member being mounted to a rotating wheel wherein each said complementary die member is adapted to inter engage when a carton blank is positioned between the two members, such that said die members cause the blank to be folded to define said article receiving cells, one of said complementary die members having a protruding portion extending from a working face thereof and the other of said complementary die members having a recessed portion adapted to receive said protruding portion, when said blank is placed on said receiving member the protruding portion forces part of the blank into said receiving portion, wherein each article includes a label affixed thereto and further includes a portion protruding outwardly of the article in a fixed position relative to said label, the packaging machine further comprising support means adapted to support an article, orientation means adapted to cause the article to rotate in the support means until the protruding position is restrained by abutment means formed in said support means to orient said group of articles prior to loading the articles into the carton.

7. A mechanism for forming a carton including a pair of article receiving cells, the mechanism comprising complementary die members, each said die member being mounted to rotating wheel wherein each said complementary die member is adapted to inter engage when a blank is positioned between the two members, such that said die members cause the blank to be folded to define said article receiving cells, one of said complementary die members having a protruding portion extending from a working face thereof and the other of said complementary die members having a recessed portion adapted to receive said protruding portion, when said blank is placed on said receiving member the protruding portion forces part of the blank into said receiving portion.

8. A mechanism for grouping a plurality of articles, comprising an endless series of channels along which articles may be transferred into a plurality of article receiving cells of a carton wherein the channels are organised into groupings whereby each grouping corresponds to a given number of grouped articles to be loaded into the carton, the channels adapted to be substantially parallel to one another and then diverge into sub-groupings to divide the grouped articles into sub-groups, wherein each said sub-grouping is spaced to align an article held in each said sub-group with one of said article receiving cells corresponding to each one of the cells of each carton and wherein the sub-groupings are each substantially parallel to one another to provide in line parallel access to the cells.

9. An apparatus for causing a label affixed to an article to be oriented to a predetermined display position wherein the article includes a portion protruding outwardly of the article in a fixed position relative said label, comprising:

a support adapted to support the article;

an elongate member adapted to cause the article to rotate in the support until the protruding portion is restrained by abutment means formed in said support, said support comprising a channel including a support surface to retain part of the article within said channel, said support surface substantially corresponding to the exterior surface of said retained part of the article;

resilient means connected to said elongate member; and wherein said elongate member is adapted to abut a portion of said article as said support is moved in a substantially parallel plane to said elongate member such that a tangential force is applied to said abutting portion of the article to cause the article to rotate.

* * * * *